United States Patent [19]

Wolf

[11] Patent Number: 4,458,232

[45] Date of Patent: Jul. 3, 1984

[54] QUENCHING BAFFLES FOR AN ELECTRICAL OVERLOAD FUSE

[75] Inventor: Johann Wolf, Bubenreuth, Fed. Rep. of Germany

[73] Assignee: Siemens Aktiengesellschaft, Munich, Fed. Rep. of Germany

[21] Appl. No.: 304,032

[22] Filed: Sep. 21, 1981

[30] Foreign Application Priority Data

Sep. 23, 1980 [DE] Fed. Rep. of Germany ..... 3035873

[51] Int. Cl.[3] ..... H01H 85/38

[52] U.S. Cl. ..... 337/273; 337/280; 337/282

[58] Field of Search ..... 335/280, 273, 282, 274, 335/290, 295

[56] References Cited

U.S. PATENT DOCUMENTS

| | | | |
|---|---|---|---|
| 854,724 | 5/1907 | Dempster | 337/280 |
| 1,946,553 | 2/1934 | Sundt | 337/231 |
| 1,959,770 | 5/1934 | Slepian | 337/280 |
| 2,067,541 | 1/1937 | Nobuhara | 337/280 X |

*Primary Examiner*—George Harris

*Attorney, Agent, or Firm*—Kenyon & Kenyon

[57] ABSTRACT

An overload fuse with a fusible conductor and quenching baffles is curved preferably forming a partial annulus, and several quenching baffles are disposed perpendicular to the fusible conductor. Due to its flat design, this fuse has only a small volume and at the same time a large switching capacity because the partial arcs formed between the quenching baffles are driven radially outward by the dynamic forces and are lengthened accordingly.

12 Claims, 9 Drawing Figures

QUENCHING BAFFLES FOR AN ELECTRICAL OVERLOAD FUSE

BACKGROUND OF THE INVENTION

This invention relates to electrical overload fuses in general and more particularly to an electrical overload fuse with a fusible link and quenching baffles of electrically conductive material.

As is well known, a fuse has as its purpose disconnecting part of a network or an electrical load in case of an overload or a short circuit. The fusible conductor is designed so that it melts as soon as the conductor current reaches a predetermined limit. By the special mechanical design of the fuse, the arc is forced to assume an operating voltage which is higher than the driving line voltage.

In the known fuses, the fusible conductor has essentially two purposes, namely, the current carrying function for the current flowing during normal operation and, for an overcurrent, which must likewise be carried for a certain period of time in the case of a disturbance or short circuit. It also has the current interrupting function which is obtained by a sufficiently large countervoltage. The two functions, however, place contradictory requirements on the fusible link, which, for higher voltages, leads to relatively complicated shapes of the fusible conductor.

A sufficiently high arc voltage can be produced by the fusible link, after it has melted through, only with a correspondingly great length. This, however, means a correspondingly large voltage and power drop during normal operation. In order to reduce this voltage drop, fusible links with several constrictions have been used. This design, however, raises a further problem, namely, the simultaneous melting of all constrictions (U.S. Pat. No. 1,946,553).

But even with this known design the voltage drop is still several tenths of a volt. In systems with a larger number of such fuses, for instance, in static converters with thyristors, with each of which a fuse is associated, a considerable amount of dissipation loss is therefore generated which must be removed as heat.

The problem of designing the fuse so that its voltage drop is small during normal operation and so that it is, at the same time, able to build up a large countervoltage which acts as the quenching voltage for interrupting the current, therefore arises.

In one known embodiment of a fuse, quenching baffles of electrically conductive material are therefore provided having flat sides extending transversely to the longitudinal direction of the fusible conductor and arranged one behind the other in the longitudinal direction thereof. As the fusible conductor melts, partial arcs are produced between the quenching baffles. Alternating with the quenching baffles are spaces in the form of hollow cylinders of a material which gives off a gas which acts as a quenching gas under the action of the arc. The fuse must therefore be pressure proof. The sum total of the individual partial arcs acts as a quenching voltage. The quenching baffles extend perpendicular to the direction of the fusible conductor and are arranged one behind the other in the direction of the fusible conductor. For higher switching voltages, especially above 1000 volts and with a correspondingly large number of quenching baffles, a relatively large design of the fuse is obtained.

SUMMARY OF THE INVENTION

According to the present invention, the abovementioned problem now is solved by using a curved conductor and disposing several quenching baffles at least approximately perpendicular to the fusible conductor. Through the quenching baffles which are arranged perpendicular to the curved fusible conductor, in particular radially to a circular fusible conductor, a flat design of the fuse is obtained, the height of which is not substantially greater than the height of the quenching baffles. The mutual spacing of the quenching baffles increases in the direction radially outward. The partial arcs generated after the fusible conductor has melted, are therefore driven outward due to the electrodynamic forces. The lengths of the individual partial arcs and the total length of the arc are increased, and the switching voltage is increased accordingly. Because of these electrodynamic forces, the fusible conductor, in a heated condition, is at the same time pressed against the baffle, and increased cooling is ensured thereby.

One embodiment of the fuse for higher voltage with a large number of quenching baffles has a fusible conductor which forms a helix, having two or more turns are arranged one over the other.

In one embodiment of the fuse, the quenching baffles can rest directly against the fusible conductor. The fusible conductor is cooled by the baffles and can carry a current which is substantially larger than the current which is obtained from the cross section of the uncooled fusible conductor. The fusible conductor can advantageously be arranged on the cylindrical surface of a hollow cylindrical core. The ends of the quenching baffle facing away from the fusible conductor can preferably be arranged in slots in the inner wall of a hollow cylindrical housing of insulating material. In that case the dimensional tolerances of the quenching baffles can be correspondingly larger.

In some circumstances it may be advisable to design the quenching baffles in such a manner and to arrange them around the fusible conductor so that their ends are opposite the fusible conductor with a predetermined spacing. The cooling effect of the quenching baffles then sets in only at a predetermined current.

In a special embodiment of the overload fuse, the ends of the quenching baffle facing the fusible conductor may be provided with a coating of low electric conductivity which may, however, have high thermal conductivity. Also the fusible conductor may be provided with such a coating instead of the quenching baffles.

Parts of the hollow cylindrical housing, preferably the outer tube, may consist of gas permeable material, especially filter ceramics so that overpressure that may occur can be relieved.

DETAILED DESCRIPTION

Figure 1:
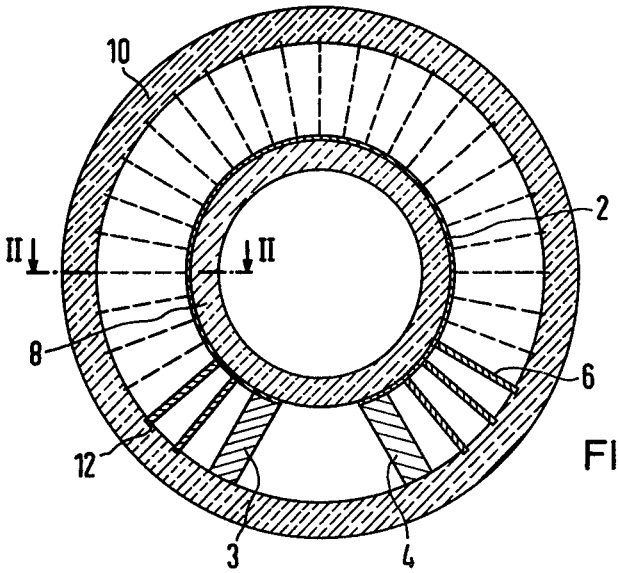
FIG. 1 is a schematic cross section an embodiment of a fuse according to the present invention.

In the embodiment according to FIG. 1, a fusible conductor 2 in the form of an annulus or hollow cylinder is shown. At both of its ends it is provided with a contact terminal, which are designated as 3 and 4 in the figure. Extending radially to the fusible conductor 2 are quenching baffles 6 of which only a few are shown in the figure, and the position of the others is merely indicted by dashed lines. The fusible conductor is arranged on the outer surface of a core 8 of insulating material which preferably has the shape of a hollow cylinder. This assembly is arranged in a housing 10 which may preferably consist of insulating material, particularly ceramics.

Figure 2:
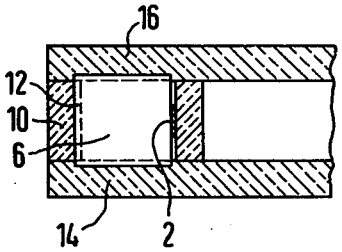
FIGS. 2 and 3 each show part of a special embodiment of the fuse.

According to FIG. 2, which is a cross-section along line II—II of FIG. 1, one end of the quenching baffles 6 rest against the fusible conductor 2 which has the form of a cylinder. The outer ends of the quenching baffles extend into slots 12 in the housing 10. Similarly, the lower and upper end faces of the quenching baffles 6 can be arranged in slots in a base plate 14 and a cover plate 16, respectively.

The housing 10 and, optionally, also at least the outer part of the base plate 14 and the cover plate 16 may advantageously consist of a gas permeable material, especially a so-called filter ceramic. The arc can be prevented from restriking at the outer surfaces of the fuse by making the holes not substantially larger than 1 mm, and, in particular, smaller than 1 mm.

Figure 3:
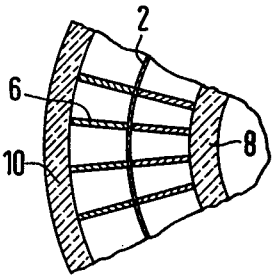

In the embodiment according to FIG. 3 which shows part of a cross section similar to the section of FIG. 1, the fusible conductor 2 is arranged between the core 8 and the housing 10 in such a manner so that the quenching baffles 6 extend radially outward as well as also radially inward from fusible conductor 2.

If the fusible conductor 2 is connected to the quenching baffles 6 in a form locking manner, all parts of the fuse are heated slowly in the case of an overcurrent, and after a predetermined time, the fusible conductor 2 melts between the quenching baffles 6. The partial arcs drawn between the individual quenching baffles are driven radially outward due to the electrodynamic forces; the arc length increases with increasing distance of the quenching baffles 6 and the switching voltage is increased correspondingly. The same electrodynamic forces press the fusible conductor 2, in the heated condition, against the quenching baffles 6 and correspondingly increased cooling is ensured.

In the embodiment according to FIG. 3 with quenching baffles 6 extending radially outward as well as radially inward, the heat removal from the spaces between the quenching baffles 6 is facilitated. In order to prevent parallel discharge channels, the quenching baffles can, in this embodiment, also be held in slots in the housing 10 as well as in slots in the outer cylindrical surface of the core 8. Because of the meander shaped extension of the leakage current paths, increased dielectric strength is then also obtained.

Figure 4:
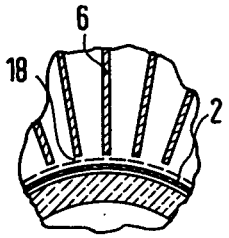
FIGS. 4 and 5 each show part of a special design of the quenching baffles.
Figure 5:
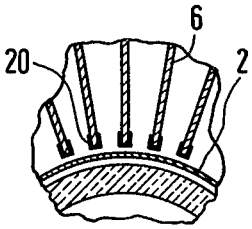

In the embodiment according to FIG. 4, the quenching baffles 6 are designed and arranged about the fusible conductor 2 in such a manner that between them and the fusible conductor 2 a gap 18 is produced. The size of the gap is chosen so that the arc generated after the fusible conductor 2 has melted at one point, allows the fusible conductor 2 to melt further, and its size will generally not be much less than 1 mm. In some circumstances the ends of the quenching baffles 6 facing the fusible conductor 2 may be provided with a coating 20 which consists of a material of low electric conductivity, as is indicated in FIG. 5. During the melting and continued melting of the fusible conductor 2, this coating 20 prevents a fusion with one or more quenching baffles 6. The coating 20 may consist, for instance, of a temperature resistant plastic, or a vitreous or enamel-like material.

Figure 6:
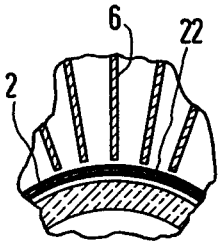
FIG. 6 illustrates a special design of the fusible conductor.

In the embodiment according to FIG. 6, the fusible conductor 2 is provided at least partially with a coating 22 which similarly prevents the mentioned fusion. If a flat, ribbon-like fusible conductor 2 is used, it can be provided with such a coating on its flat side facing the quenching baffle 6. It may be sufficient in some circumstances if, between the fusible conductor 2 and the quenching baffles, an intermediate layer provided with openings is arranged, the openings of which allow the arc to pass after the fusible conductor 2 is melted.

Figure 7:
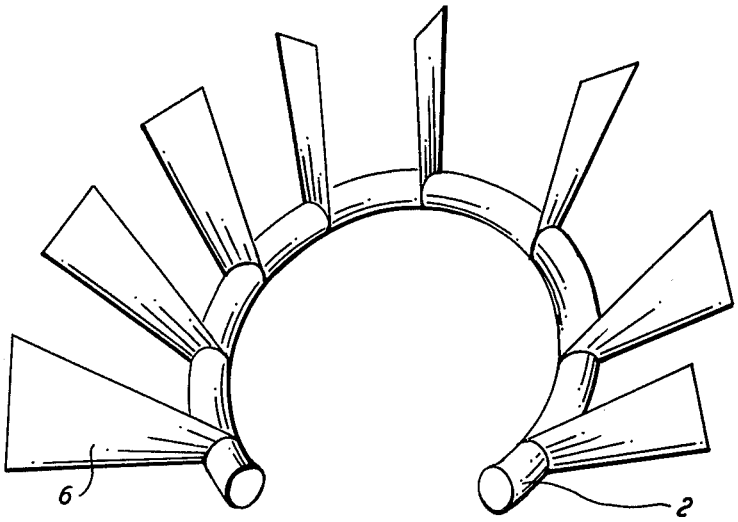
FIG. 7 illustrates a fuse in a partial annulus with radially extending baffles.

FIG. 7 shows a fusible conductor 2 arranged in a partial annulus and having quenching baffles 6 extending radially outward.

Figure 8:
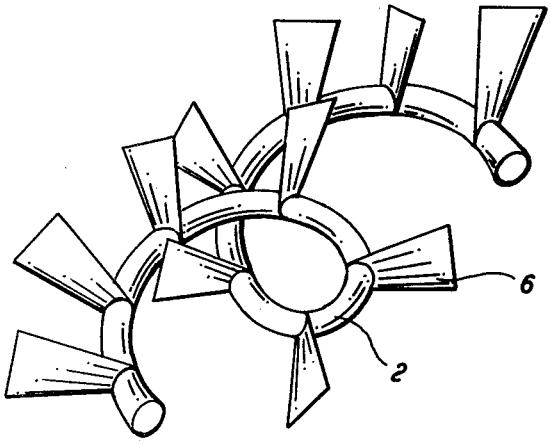
FIG. 8 shows the fuse in a helical form.

In FIG. 8, the construction is similar to that of FIG. 7 except that conductor 2 takes a helical form with a plurality of turns, one over the other.

Figure 9:
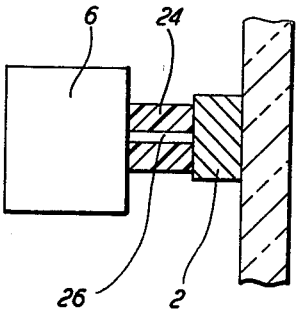
FIG. 9 shows an intermediate layer between the fuse and baffles.

FIG. 9 shows a view similar to that of FIG. 2 where an intermediate layer of a material of low electrical conductivity 24 is disposed between the baffles 6 and conductor 2. Gaps 26 are formed to provide passage openings for an arc.

What is claimed is:

1. In an electrical overload fuse with a fusible conductor and quenching baffles of electrically conductive material, the improvement comprising, the fusible conductor being curved along a radius of curvature about an axis, forming a continuous curve from one end to the other and a plurality of quenching baffles disposed at least approximately perpendicular to the fusible conductor and extending radially with respect to said axis.

2. The improvement according to claim 1, wherein said fusible conductor is disposed on the outer surface of a hollow cylindrical core.

3. The improvement according to claim 2, wherein said quenching baffles contact said fusible conductor.

4. The improvement according to claim 2, wherein the ends of said quenching baffles are spaced from the fusible conductor.

5. The improvement according to claim 4 wherein the ends of said quenching baffles have a coating of a material of low electric conductivity.

6. The improvement according to claim 4, wherein said fusible conductor is at least partially covered with a coating of a material of low electric conductivity.

7. The improvement according to claim 4, and further including an intermediate layer of a material of low electric conductivity having passage openings for the arc disposed between the fusible conductor and the quenching baffles.

8. The improvement according to claim 2 and further including a hollow cylindrical housing of insulating material having slots on its inside wall surrounding said conductor and baffles, said quenching baffles extending into said slots.

9. The improvement according to claim 7 at least part of said housing consists of a gas permeable material.

10. The improvement according to claim 9, wherein said gas permeable material is filter ceramic.

11. In an electrical overload fuse with a curved fusible conductor and quenching baffles of electrically conductive material, the improvement comprising the fusible conductor extending in a partial annulus and a plurality of quenching baffles extending radially from the fusible conductor over said annulus.

12. In an electrical overload fuse with a curved fusible conductor and quenching baffles of electrically conductive material, the improvement comprising the fusible conductor extending in a helix and said quenching baffles extending perpendicularly from said fusible conductor over the helix.

* * * * *